United States Patent [19]

Smart et al.

[11] 4,190,875

[45] Feb. 26, 1980

[54] APPARATUS FOR REMOVING PARTICULATE MATTER FROM AN ATMOSPHERE

[75] Inventors: William L. Smart, Indianapolis, Ind.; Stuart A. Hoenig, Tucson, Ariz.

[73] Assignee: The Ritten Corporation, Ltd., Ardmore, Pa.

[21] Appl. No.: 729,204

[22] Filed: Oct. 4, 1976

[51] Int. Cl.[2] ..... B05B 5/02; B03C 3/16

[52] U.S. Cl. ..... 361/228; 55/107; 239/706

[58] Field of Search ..... 55/107, 120; 239/3, 239/15, 406; 361/227, 229, 228; 118/629

[56] References Cited

U.S. PATENT DOCUMENTS

| | | | |
|---|---|---|---|
| 2,302,185 | 11/1942 | Campbell, Jr. | 239/15 |
| 2,302,289 | 11/1942 | Bramston-Cook | 239/15 |
| 3,210,008 | 10/1965 | Liedberg et al. | 55/107 |
| 3,326,182 | 6/1967 | Inoue | 239/15 |
| 3,476,319 | 11/1969 | Thatcher | 361/227 |
| 3,606,972 | 9/1971 | Ferrant | 239/15 |
| 3,698,635 | 10/1972 | Sickles | 239/15 |
| 3,729,898 | 5/1973 | Richardson | 55/107 |

FOREIGN PATENT DOCUMENTS

| | | | |
|---|---|---|---|
| 686779 | 1/1953 | United Kingdom | 55/107 |
| 395088 | 12/1973 | U.S.S.R. | 239/15 |

*Primary Examiner*—Frank W. Lutter
*Assistant Examiner*—David L. Lacey
*Attorney, Agent, or Firm*—Caesar, Rivise, Bernstein & Cohen, Ltd.

[57] ABSTRACT

A compact apparatus for removing harmful particulate contaminants from the air in a work space includes a nozzle for atomizing water. The nozzle is connected to a supply of compressed air and to a supply of water, e.g., an ordinary water tap or storage tank. The apparatus also includes a metal ring and a power supply coupled to the ring to charge atomized water inductively as the water is expelled from the nozzle. A collar supports the ring in fixed, spaced-apart relation adjacent the nozzle. The collar is constructed, at least in part, from a non-conductive plastic, such as nylon, to avoid shorting of the power supply. Additionally, the collar includes a compressed air supply passage for introducing a stream of air into the collar. This air flows past the nozzle and the ring to prevent accumulation of water on the ring and collar and the electrical shorting which may result therefrom. Additionally, the stream of air minimizes degradation of the electrical charge on the fog of atomized water which would otherwise result from the addition thereto of oppositely charged water particles originating from the accumulation of water on the ring.

13 Claims, 6 Drawing Figures

APPARATUS FOR REMOVING PARTICULATE MATTER FROM AN ATMOSPHERE

This invention relates to apparatus for removing contaminants from an atmosphere, and particularly particulate contaminants of respirable size having an inherent electrical charge, to cause agglomeration and resultant precipitation of such respirable particles from an atmosphere.

With the advent of occupational safety and health standards in many industries, and the enforcement of such standards, considerable effort has been directed toward methods and apparatus for reducing or eliminating harmful and deleterious contaminants from working environments. Particular emphasis has been placed upon reducing the concentrations of particles of respirable size (7 microns in diameter and smaller) in such working environments.

Many systems have been suggested for reducing concentrations of atmospheric contaminants in fixed locations where contaminated air from a work environment can be collected, filtered and returned to the environment. See, for example, U.S. Pat. No. 2,788,081, issued Apr. 9, 1957, to E. M. Ransburg, and assigned to the same assignee as the present invention. Conventional types of systems include electrostatic precipitators, cyclones, bag houses, and other similar devices. In many situations, however, such systems simply are not adaptable to remove contaminants produced by particular operations. For example, if the source of contaminants is very large, e.g., a coke oven, or is not stationary, e.g., a truck, conventional contaminant control systems cannot readily be used.

It is known that atomized liquids can be inductively charged by passing a spray of atomized liquid particles through a ring which is maintained at some potential relative to the atomizing apparatus. See, for example, U.S. Pat. No. 2,302,185, issued Apr. 17, 1942, to J. A. Campbell, Jr. In that patent, there is disclosed a hand-held apparatus for inductively charging an atomized oil spray. The oil spray is used to coat the leaves of plants.

An object of the present invention is to provide for such applications a compact apparatus, capable of being made portable, which would induce rapid agglomeration and precipitation of respirable particulate matter. Such a portable system would use a minimum quantity of an agglomerating liquid, e.g., water.

According to the invention, an apparatus for removing electrically charged particulate contaminants from an atmosphere includes means for atomizing and dispensing liquid. Means are provided for changing the atomized particles of liquid as the particles are expelled from the atomizing means. A power supply is coupled to the charging means to provide the charging potential thereto. A collar supports the charging means adjacent the atomizing means. The collar is fabricated, at least in part, from an insulating material to minimize the likelihood of shorting of the power supply.

In one embodiment, the collar comprises a generally cylindrical inner wall having open forward and rearward ends. The atomizing means includes a nozzle attached to the collar to lie generally along the axis of the inner wall. The charging means comprises a ring which is coaxial with the collar and nozzle and attached to the inner wall. The collar includes an annular barrier projecting radially inwardly from the inner wall rearwardly of the nozzle and ring. A gas supply passage is provided forward of the barrier to introduce a pressurized gas inwardly from the interior wall between the barrier and the open forward end of the collar. Preferably, the passage is generally tangential to the inner wall. Gas moving through the passage swirls forward past the ring and nozzle. This swirling flow minimizes accumulation of liquid on the ring, and particularly in the region of the collar. This minimizes the likelihood of shorting of the power supply through the accumulated liquid.

In the illustrated embodiment, the gas is compressed air and the liquid is water.

The invention may best be understood by referring to the following description of an embodiment thereof, and the accompanying drawings which illustrate that embodiment. In the drawings.

Figure 1:
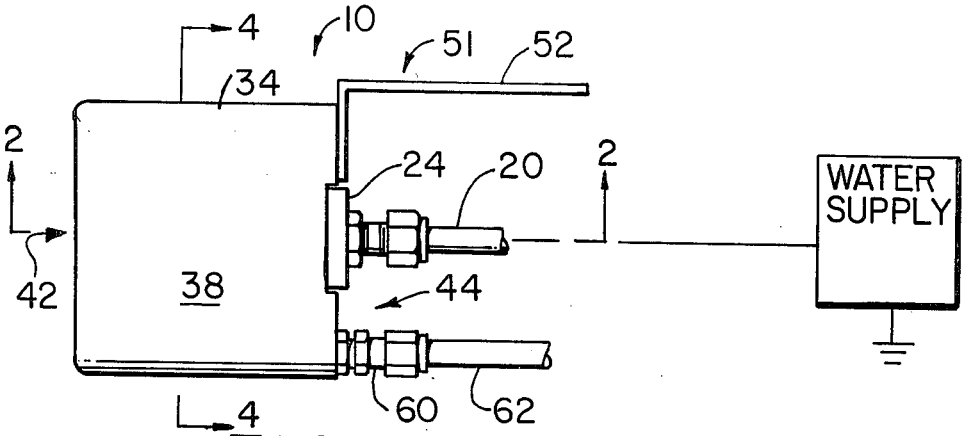
FIG. 1 is a side elevational view of an apparatus constructed in accordance with the present invention.
Figure 2:
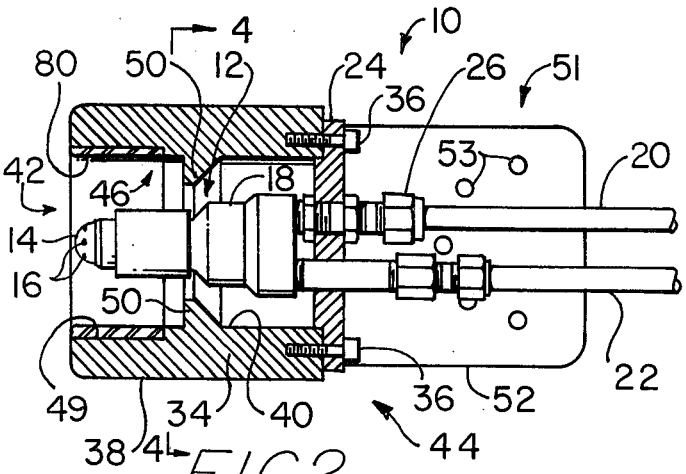
FIG. 2 is a sectional view of the apparatus of FIG. 1 taken generally along section lines 2—2 thereof.

Referring now to the drawings, an apparatus 10 is provided for removing charged particulate contaminants from the atmosphere, typically in a work area in which respirable particulate contaminants are generated by work that is being performed. Apparatus 10 includes a head 12 for atomizing water which may be of conventional internal-mix or external-mix design. Head 12 is of the internal-mix design and includes a dispensing nozzle 14 having a plurality of orifices 16 through which the atomized water is expelled. Head 12 includes a mixing chamber 18 in which water is mixed with compressed air, atomizing the water. Two hoses 20, 22 are connected to mixing chamber 18 to provide water and compressed air, respectively, thereto. Head 12 and hoses 20, 22 are connected together and to a mounting bracket 24 by air and water fittings 26, 28, respectively. Head 12 may be of a type including a nozzle which atomizes by high liquid pressure without compressed air, such as is shown in U.S. Pat. No. 3,659,787, owned by the assignee of this application.

A collar 34 is attached to mounting bracket 24 by a pair of fasteners 36. Collar 34 is generally cylindrical in shape, having a cylindrical outer wall 38 and a generally cylindrical inner wall 40. Collar 34 is open at its forward end 42 and rearward end 44. Inner wall 40 is divided into a forward portion 46 and rearward portion 48 by a radially inwardly projecting annular barrier 50. Wall 40 includes a region 49 of increased radius. A mounting bracket 51 is attached to the rearward end 44 of collar 34. Bracket 51 includes a mounting plate 52 provided with a plurality of mounting holes 53.

Figure 4:
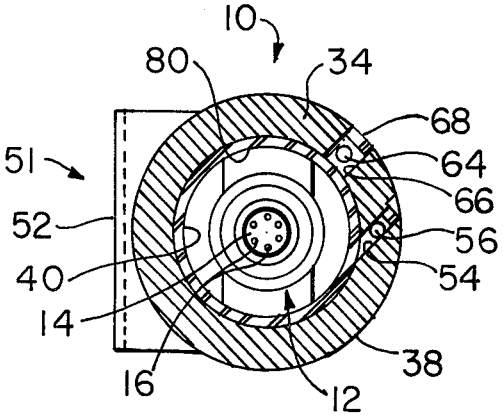
FIG. 4 is a sectional view of the apparatus of FIGS. 1–3 taken generally along section lines 4—4 of FIGS. 1, 2.
Figure 6:
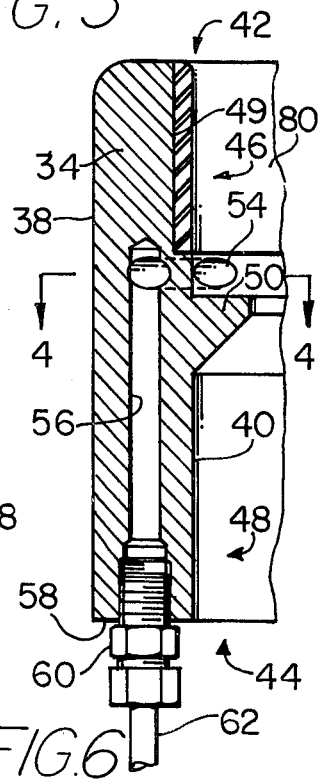
FIG. 6 is a fragmentary sectional view of the apparatus of FIGS. 1–5 taken generally along section lines 6—6 of FIG. 3.

As best illustrated in FIGS. 4, 6, collar 34 is provided with an air passage 54 provided in the forward portion 46 of the interior of the collar. Passage 54 extends generally tangentially of the inner wall 40 of collar 34 from a chamber 56. Chamber 56 extends longitudinally of collar 34 from a rearward surface 58 thereof to intersect passage 54. Chamber 56 is provided with a fitting 60 for attachment of an air line from a source of compressed air (not shown). The source of compressed air therefore can be the same as the compressed air source for head 12. Desirably, however, the pressure of the air supplied to chamber 56 is reduced substantially below the pressure supplied to head 12, e.g., by a factor of 8. For this purpose, air line 62 may be fitted with a restrictor (not shown).

Figure 5:
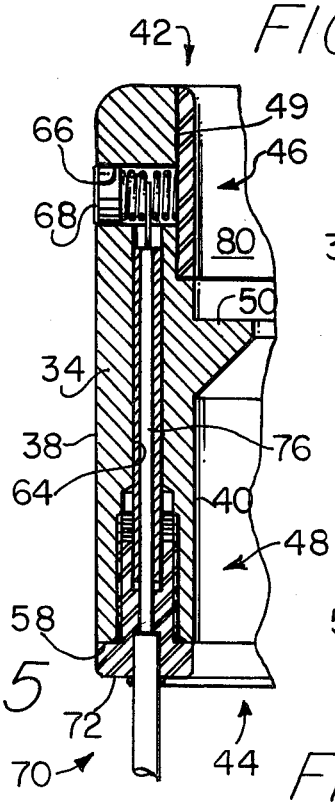
FIG. 5 is a fragmentary sectional view of the apparatus of FIGS. 1–4 taken generally along section lines 5—5 of FIG. 3.

As best illustrated in FIGS. 4–5, collar 34 further includes a bore 64 which extends longitudinally of the collar from surface 58. A second bore 66 extends radially of the collar between walls 38, 40 into region 49. A plug 68 is provided for bore 66.

Figure 3:
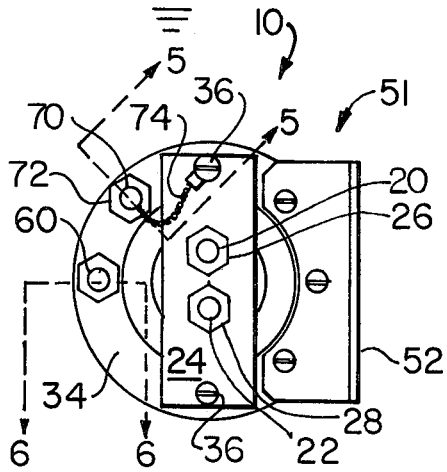
FIG. 3 is a rear elevational view of the apparatus of FIGS. 1–2.

Bore 64 receives a braided coaxial cable 70 which is attached to collar 34 by a strain relief attachment nut 72. As best illustrated in FIG. 3, a portion of the braid 74 of cable 70 is stipped therefrom and is attached to bracket 24.

A generally cylindrical ring 80 of conductive material located in region 49 of collar 34 is electrically connected to the conductor of cable 70 by a spring as shown in FIG. 5 which is retained in bore 66 by plug 68. The other end (not shown) of center conductor 76 is coupled to a voltage supply which is capable of producing a potential of, for example, 7 KVDC with respect to ground, on ring 80. Desirably, the polarity of this potential is selectively variable for purposes which will be explained hereinafter. The other end of braid 74 is coupled to the supply ground, thereby grounding head 12 and its associated components.

In its preferred mode of operation, apparatus 10 takes advantage of the inherent charge present on most respirable particulate contaminants. The presence of this charge, its polarity and magnitude, are documented in, for example, a paper titled APPLICATION OF ELECTROSTATIC FOG TECHNIQUES TO THE CONTROL OF RESPIRATORY PARTICULATES, by Hoenig, Russ and Bidwell, published by the Department of Electrical Engineering, University of Arizona, Tucson, Ariz. 85721, dated Apr. 16, 1976, and revised May 1, 1976.

As the above-identified Hoenig et al publication indicates, airborne respirable contaminants occur in both positively and negatively charged varieties. To an extent, the charge carried by a particular contaminant particle seems to be related to the size of the particle. When atomized water particles are inductively charged, as with the present apparatus, the polarity of the charge induced in the water particles is opposite the polarity to the potential impressed upon the ring 80. Thus, to produce positively charged atomized water particles capable of attracting and agglomerating negatively charged contaminant particles, it is necessary that a negative potential be impressed upon ring 80. Conversely, to produce negatively charged atomized water particles capable of attracting and agglomerating positively charged contaminant particles, it is necessary that a positive potential be impressed upon ring 80. It is desirable, therefore, to use a potential supply adapted to produce either a positive or negative potential with respect to ground. The proper connections between the supply and the apparatus of the present invention can then be made to remove contaminant particles having either positive or negative charges from the work atmosphere.

Since the possibility exists that some of the atomized water particles will accumulate on collar 34, either on or in the vicinity of ring 80, air passage 54 is provided to help circulate air through the collar 34 across inner wall 40 thereof. The tangential orientation of passage 54 with respect to wall 40 provides a spiraling flow of air across wall 40 and outwardly through forward end 42. This spiraling air flow minimizes accumulation of water on wall 40. This in turn minimizes the likelihood of "tracting" of the potential impressed upon ring 80 to grounded parts of apparatus 10 through the accumulated water. An additional advantage of keeping wall 40, and particularly ring 80, dry is that water is prevented from assuming a charge having the same polarity as the ring 80. Such "likecharged" water can be attracted back into the fog of "oppositely-charged" water being dispensed from nozzle 12, adversely affecting the total charge which is being dispensed into the atmosphere. Such reduction of the total charge dispensed into the atmosphere reduces the amount of particulate contaminants that can be removed from the atmosphere by the fog.

The potential supply to ring 80 is also important in minimizing the possibility of tracking and corona discharge from the ring 80. In the illustrated embodiment, a ±7 KVDC supply is used.

A significant advantage of the illustrated system is that there is no need to insulate the water supply to which apparatus 10 is connected so that the supply itself can be held at a high potential. A system with an insulated water supply would, of course, be extremely difficult to incorporate into most industrial applications. With the present system, the water supply need not be electrically insulated, since a charge is induced on the atomized water particles.

An additional advantage of the apparatus of the present invention resides in the small size of the apparatus and the minimum complexity of the services required to operate it. Since a quite effective apparatus 10 can operate with only water, compressed air at, e.g., 75 psi or less for nozzle 12 and 25 psi or less for passages 54, 56, and a ring 80 supply of under 10 KVDC, the apparatus can readily be made portable.

While the apparatus 10 is disclosed as utilizing the inherent charge on particulate contaminants, it must be understood that this apparatus could be used with apparatus which induces a charge on particulate contaminants. The charged fog generated by apparatus 10 would then be charged oppositely to the particulate contaminants to attract, agglomerate and precipitate them from the atmosphere.

I claim:

1. Apparatus for removing contaminants from an atmosphere comprising means for dispensing atomized particles of pollution control liquid, means connecting a supply of such pollution control liquid to the dispensing means, means for inductively charging the particles of liquid as the particles are atomized to generate a charged fog of pollution control liquid particles, a power supply for energizing the charging means connected to the charging means, and a collar fabricated from an insulating material and having a generally cylindrical inner wall and open forward and rearward ends, and means for supporting both the dispensing means and the charging means interiorly of the collar in fixed spaced-apart relation.

2. The apparatus of claim 1 wherein the dispensing means comprises a nozzle lying generally along the central axis of the collar and the charging means comprises a metal ring co-axial with and attached to the inner wall of the collar.

3. The apparatus of claim 2 wherein the collar includes an annular barrier projecting radially inwardly from the inner wall thereof and located axially rearwardly from the nozzle and ring.

4. The apparatus of claim 3 and further comprising means defining a gas supply passage forward of the barrier to introduce pressurized gas inwardly from the interior wall of the collar.

5. The apparatus of claim 4 wherein the gas supply passage is adjacent the barrier and directed generally tangential to the interior wall to cause gas moving therethrough to swirl forward past the ring and nozzle and minimize the accumulation of liquid on the ring and collar.

6. Apparatus for removing contaminants from an atmosphere comprising an atomizing nozzle, means connecting a supply of pollution control liquid to the nozzle, a cylindrical conductive ring for inductively charging atomized particles of pollution control liquid as the particles are expelled from the nozzle into the atmosphere to generate a charged fog of pollution control liquid particles to attract charged contaminant particles, means for supplying an electrostatic charge to the ring, and a collar for supporting the ring in fixed spaced-apart relation to the nozzle, the ring being supported from the collar and the nozzle being supported interiorly of the collar, the collar being constructed from an insulating material with open forward and rearward ends and an interior defined by a generally cylindrical inner wall, the collar including means for connecting the ring to its electrostatic charging means, and the collar further including means for maintaining a flow of gas into the interior of the collar to minimize the accumulation of pollution control liquid on the ring and collar.

7. The apparatus of claim 6 wherein the nozzle is located substantially on the axis of the inner wall of the collar, and the ring is supported by the inner wall in substantially coaxial relation to the nozzle.

8. The apparatus of claim 7 wherein the ring and the nozzle lie adjacent the open forward end of the collar to minimize interference of the ring and collar with the expelled atomized liquid and maximize inductive charging of the atomized particles by the ring.

9. The apparatus of claim 6 wherein the gas flow-maintaining means includes a passageway extending generally tangential to the inner wall of the collar and opening into it.

10. Apparatus for removing contaminants from an atmosphere comprising means for atomizing and dispensing particles of a pollution control liquid, an electrically conductive ring for inductively charging the atomized pollution control liquid particles, means for supplying electrostatic charge to the ring, means for supplying pollution control liquid to the atomizing means, an electrically non-conductive collar for supporting the charging ring adjacent the dispensing means to direct atomized pollution control liquid particles from the dispensing means through the charging ring to generate a charged fog of pollution control liquid, and means for maintaining a flow of gas through the charging ring to minimize the accumulation of liquid on the charging ring and supporting collar.

11. The apparatus of claim 10 wherein the gas flow-maintaining means includes a gas passage through the inner wall of the collar, the gas passage opening into said inner wall generally tangentially of the inner wall to provide a swirling flow of gas within the collar interior.

12. Apparatus for removing contaminants from an atmosphere comprising means for atomizing and dispensing particles of a pollution control liquid means connecting a supply of said pollution control liquid to the atomizing means, means for inductively charging the atomized pollution control liquid particles, means for supporting the charging means adjacent the dispensing means to direct atomized particles of pollution control liquid past the charging means to generate a charged fog of pollution control liquid particles, and means for maintaining a flow of gas over the charging means to minimize the accumulation of pollution control liquid on the charging means and supporting means, the supporting means comprising a non-conductive collar having an inner wall and open forward and rearward ends defining a collar interior.

13. Apparatus for removing contaminants from an atmosphere comprising means for atomizing and dispensing particles of water, a ring for inductively charging the atomized water, means for supplying electrostatic charge to the ring, means for supporting the ring adjacent the dispensing means to direct atomized water particles through the ring, and means for maintaining a flow of gas over the ring to minimize the accumulation of water droplets on the ring and supporting means, and a grounded water supply electrically coupled to the atomizing and dispensing means to supply the water for atomization.

* * * * *